US006710772B2

(12) United States Patent
Van Dijk et al.

(10) Patent No.: US 6,710,772 B2
(45) Date of Patent: Mar. 23, 2004

(54) PLASMA DISPLAY PANEL AND METHOD OF DRIVING THEREOF

(75) Inventors: Roy Van Dijk, Eindhoven (NL); Roel Van Woudenberg, Eindhoven (NL); Petrus Maria De Greef, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/235,431

(22) Filed: Sep. 5, 2002

(65) Prior Publication Data

US 2003/0057859 A1 Mar. 27, 2003

(30) Foreign Application Priority Data

Sep. 5, 2001 (EP) ..... 01203343

(51) Int. Cl.[7] ..... G09G 5/00; G09G 3/10
(52) U.S. Cl. ..... 345/204; 315/169.3
(58) Field of Search ..... 315/169.1, 169.3; 345/3.2, 37, 41, 60, 63, 204

(56) References Cited

U.S. PATENT DOCUMENTS 6,127,992 A * 10/2000 Sano ..... 345/60
6,348,930 B1 * 2/2002 Kobayashi et al. ..... 345/672
6,373,477 B1 4/2002 Van Dijk ..... 345/204
6,473,464 B1 * 10/2002 Weitbruch et al. ..... 375/240.26
6,476,875 B2 * 11/2002 Correa et al. ..... 348/607

FOREIGN PATENT DOCUMENTS

WO WO9949448 9/1999 ..... G09G/3/36

OTHER PUBLICATIONS

"Appearance of False Pixels and Degradation of Picture Quality in Matrix Displays Having Extended Light–Emission Periods" S. Mikoshiba et al., SID 92 Digest, 1992, pp. 659–662.

* cited by examiner

*Primary Examiner*—Don Wong
*Assistant Examiner*—Minh Dien A

(57) ABSTRACT

A method of determining new luminance value data based on original luminance value data to be displayed on a matrix display device, where the luminance value data are coded in sub-fields, the sub-fields including a group of most significant sub-fields and a group of least significant sub-fields, wherein a common value for the least significant sub-fields is determined for a set of lines. In the method, a number of sub-fields values are compensated for motion artefacts and at least one of the sub-fields in two or more lines is addressed simultaneously.

15 Claims, 14 Drawing Sheets

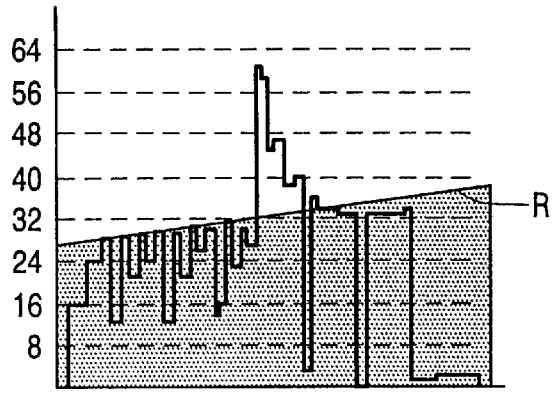
FIG. 2A
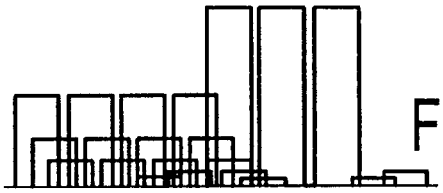
FIG. 2B
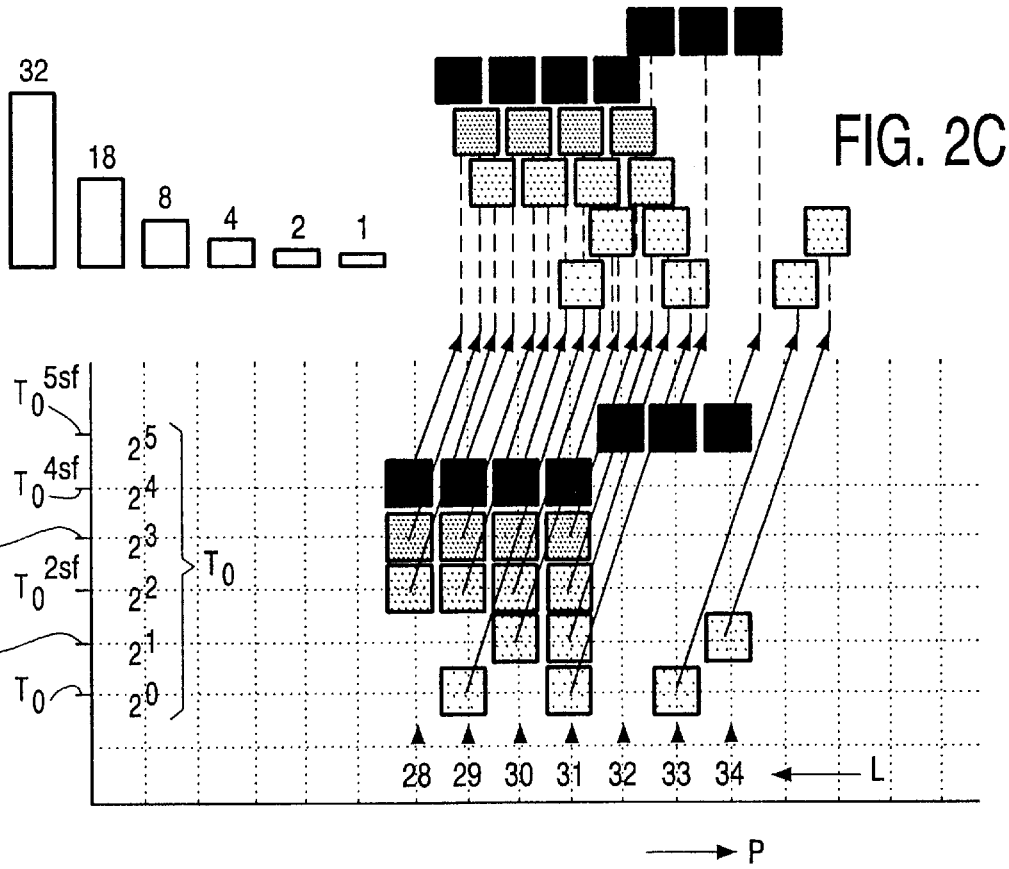
FIG. 2C
FIG. 2D

PLASMA DISPLAY PANEL AND METHOD OF DRIVING THEREOF

BACKGROUND OF THE INVENTION

1. Field of the Invention

The invention relates to a method of determining new luminance value data based on original luminance value data to be displayed on a matrix display device, where the luminance value data are coded in sub-fields, the sub-fields comprising a group of most significant sub-fields, and a group of least significant sub-fields, wherein a common value for the least significant sub-fields is determined for a set of lines.

The invention also relates to a matrix display device comprising means for determining new luminance value data based on original luminance value data to be displayed on a matrix display device in accordance with said method.

The invention may be used, e.g., in plasma display panels (PDPs), plasma-addressed liquid crystal panels (PALCs), liquid crystal displays (LCDs), Polymer LED (PLEDs), Electroluminescent (EL), television sets used for personal computers, and so forth.

2. Description of the Related Art

A matrix display device comprises a first set of data lines (rows) rl . . . rN extending in a first direction, usually called the row direction, and a second set of data lines (columns) cl . . . cM extending in a second direction, usually called the column direction, intersecting the first set of data lines, each intersection defining a pixel (dot).

A matrix display further comprises means for receiving an information signal comprising information on the luminance value data of lines to be displayed and means for addressing the first set of data lines (rows rl, . . . rN) depending on the information signal. Luminance value data are hereinafter understood to be the gray level in the case of monochrome displays, and each of the individual levels in color (e.g., RGB) displays.

Such a display device may display a frame by addressing the first set of data lines (rows) line by line, each line (row) successively receiving the appropriate data to be displayed.

In order to reduce the time necessary for displaying a frame, a multiple line addressing method may be applied. In this method, more than one, usually two, neighboring, and preferably adjacent, lines of the first set of data lines (rows) are simultaneously addressed, receiving the same data. This so-called double-line addressing method (when two lines are simultaneously addressed) effectively allows speed-up of the display of a frame, because each frame requires less data, but mostly at the expense of a loss of the quality with respect to the original signal, because each pair of lines receives the same data, which can induce a loss of resolution and/or sharpness due to the duplication of the lines.

For the above-mentioned matrix display panel types, the generation of light cannot be modulated in intensity to create different levels of gray scale, as is the case for CRT displays. On these matrix display panel types, gray levels are created by modulating in time: for higher intensities, the duration of the light emission period is increased. The luminance data are coded in a set of sub-fields, each having an appropriate duration or weight for displaying a range of light intensities between a zero and a maximum level. The relative weight of the sub-fields may be binary (i.e., 1, 2, 4, 8, . . . ) or not. This sub-field decomposition, described here for gray scales, will also apply hereinafter to the individual colors of a color display.

In order to reduce loss of resolution, line doubling can be done for, e.g., some less significant sub-fields (LSB sub-fields). Some LSB sub-fields correspond to a less important amount of light, and partial line doubling will give less or no loss in resolution.

The use of partial line doubling should be effective. Only a few LSB sub-fields doubled would yield a little gain of time. Too many sub-fields doubled would yield an unacceptable loss of picture quality.

Another aspect that influences the quality is the calculation method of the new data of doubled sub-fields. Different calculation methods giving different results can be used. The method used should give the best picture quality, as seen by the observer's eyes.

As the LSBs are doubled in partial line doubling, the value of the LSB data for two neighboring or adjacent lines must be the same. Several methods can be used for the calculation of these data, such as:

- The LSB data of odd lines is used on the adjacent even lines (simple copy of bits);
- The LSB data of even lines is used on the neighboring or adjacent odd lines (simple copy of bits);
- The average LSB data of each pair of pixels is used for both new LSB values;
- The sub-fields data of the line with the lowest luminance is copied to the other line;
- The doubled sub-fields are determined as to minimize the total error.

These methods allow a reduction of the addressing time, at the expense of a loss of resolution. However, a difference, and in some instances a large difference, may exist between the original luminance values to be displayed and the new luminance values actually displayed.

In International Patent Application No. WO 99/49448, corresponding to U.S. Pat. No. 6,373,477, a method is disclosed wherein so-called motion compensation is performed for sub-fields in a plasma display panel.

SUMMARY OF THE INVENTION

It is an object of the present invention to improve upon the above prior art method, especially with respect to reducing the addressing time in such a panel.

The present invention provides a method of driving a display wherein a field period for the display is divided into several sub-fields, and wherein:

- a number of sub-fields values are compensated for motion artefacts; and
- at least one of the sub-fields in subsequent lines is addressed simultaneously.

An advantage of this invention is that by combining steps for compensating sub-field values for motion artefacts with steps for addressing sub-fields in subsequent lines simultaneously, it is possible to achieve both a richer image with more contrast and a preferable image with less visible artefacts. By applying steps for addressing the sub-fields in subsequent (partial line doubling, PLD), it is achieved that addressing the sub-fields is done in less time thereby enabling, e.g., longer sustain periods per sub-field, which improves the amount of emitted light and thereby the brightness of the image. By applying steps for compensating sub-field values for motion artefacts, the occurrence of motion artefacts, which are visible in the image when objects move, are minimized. In a preferred embodiment of the invention, the PLD data calculation is performed first, whereafter only the non-doubled sub-fields are motion compensated while the line doubled sub-fields are not compensated. In a further preferred embodiment, motion compensation is applied first, whereafter the partial line doubling data calculation is executed.

In a further preferred embodiment, the partial line doubling is performed first for all sets of lines 2N+1 and 2N+2 (the "odd" set) and for all sets of lines 2N and 2N+1 (the "even" set), where N is an integer number. Herewith, it is preferred that the size of a vertical blocking of a motion vector is a multiple of a number of partial line doubling, as is further explained in connection with FIGS. 9, 10 and 11. In this embodiment, the multiple is preferably a multiple of the number of lines in which the same sub-field data is copied to and that is addressed simultaneously. In specific embodiments, copying is performed over a larger number of lines, e.g., when sub-fields of four lines are copied, there are four sets starting at a 1st, 2nd, 3rd and 4th line.

In further embodiments, the partial line doubling comprises steps for minimizing the error, averaging the data or copying the data during the data calculation. Especially steps for minimizing the error result in a better picture. Advantages of the copying of the date are that less calculation time is needed. An advantage of the averaging method is that a better picture is achieved than using the copying method.

In further embodiments, values of the sub-fields depend on a shift of the highest doubled sub-field. Furthermore, an embodiment is provided in which values of the sub-fields depend on a shift of the lowest non-doubled sub-field.

BRIEF DESCRIPTION OF THE DRAWINGS

The invention will now be described on the basis of the following description, which makes reference to the drawings, in which:

FIGS. 2*a*–2*d* illustrate motion artefacts for a luminance ramp at a speed of two pixels per field period;

DESCRIPTION OF THE PREFERRED EMBODIMENTS

An (AC) plasma display panel (PDP) and a digital (micro-) mirror device (DMD) are bi-level displays with a memory function, i.e., pixels (picture elements) can only be turned on or off. In conventional PDP's, three phases can be distinguished: an erase sequence, an addressing sequence and a sustain sequence. In the first sequence, the memories of all pixels are cleared. To switch a pixel on, the second addressing phase is necessary. In such a phase, the pixels are addressed on a line at a time basis. The pixels that should turn on are conditioned in such a way that they turn on when a voltage is placed across its electrodes. The conditioning is done for all pixels in a display that should be switched on. After the addressing phase, a third phase, the sustain phase, is required in which the luminance is generated. All pixels that were addressed, turn on as long as the sustain phase lasts. The sustain period is common for all pixels of a display, thus, during this sustain period, all pixels on the screen that were addressed are switched on simultaneously.

Figure 1:
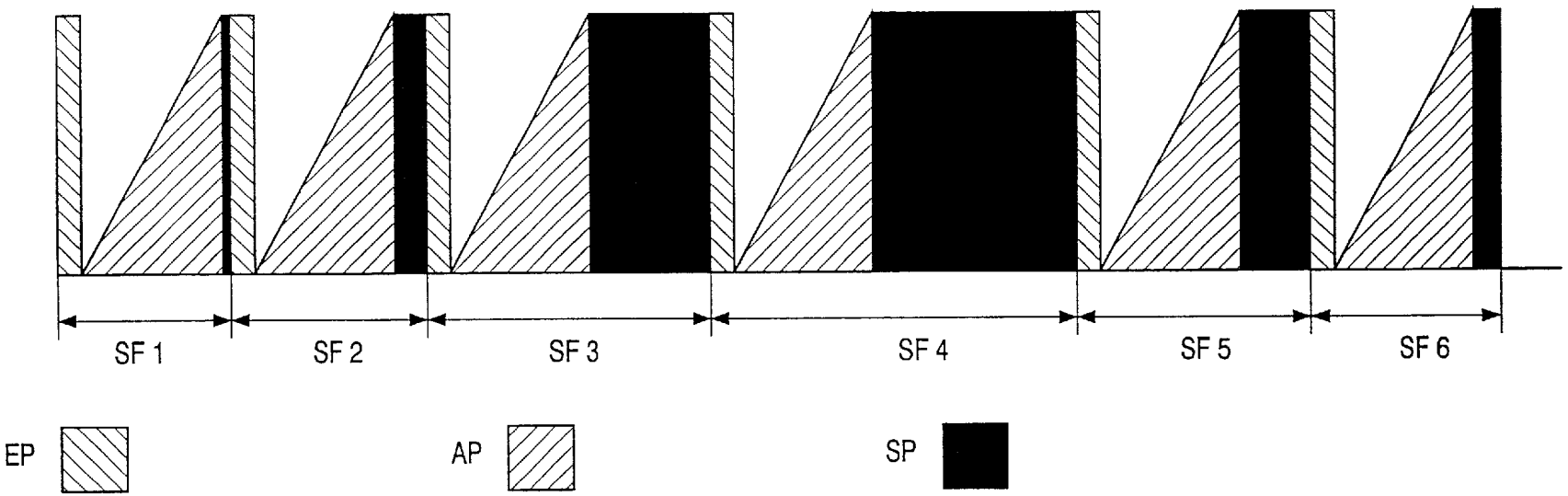
FIG. 1 illustrates an example of a field period for an AC plasma display.

The field period is divided into several sub-fields, each consisting of a sequence of erase, address and sustain. The gray-scale contribution of each sub-field is determined by varying the duration of the sustain phase, i.e., how long the pixels are switched on. The duration of the sustain phase is further denoted as the weight of a sub-field. The higher the weight of a sub-field, the higher the luminance of a pixel that is switched on during the sustain phase. The gray-scale itself is now generated in such a way that the luminance value is divided into several sub-fields in which the sub-fields have various weights, i.e., the duration of the sustain phase is proportional to a weight factor. The sub-fields can be started in two fashions; they can be equally divided over a field period, or they can start when the previous one is finished. The latter situation is shown in FIG. 1. In FIG. 1, a field period including six sub-fields SF1–SF6 is shown for a conventional PDP. Each sub-field SFi includes an erase period EP, an addressing period AP, and a sustain period SP. The length of the sustain period SP of a sub-field determines its impact on the output luminance. By combining the sub-fields (i.e., switching the sub-fields on or off) a gray-scale can be made.

FIGS. 2A–2D show the artefacts resulting from motion at a speed of 2 pixels per field period. FIG. 2D shows a Time vs. Position diagram in which the six sub-fields, together forming a first field $T_0$, are shown on the vertical axis, and position P is shown on the horizontal axis. Increasing luminance values L are set out horizontally; these luminance values are built up in a digital manner by means of the various sub-fields having binary weights. FIG. 2C shows where the various sub-field information is perceived as a result of the motion at 2 pixels per field period. FIG. 2B shows the luminance contributions of the individual sub-fields, in which the sub-field $T_0^{5sf}$ the weight $2^5$=32 is shown as the largest pillar, and the sub-field $T_0^{0sf}$ with the weight $2^0$=1 is shown as the smallest pillar. FIG. 2A shows the resulting luminance on the retina, as well as a line R indicating the intended ramp. The difference between the intended ramp and the actually perceived luminance on the retina is a problem to be solved. It can be seen, from FIG. 2A, that the observed luminance can differ a lot from the actual still image data. The method, according to this figure, calculates the precise position of the sub-fields and weights of the pixels under the assumption that the eye is perfectly tracking the motion with a speed of 2 pixels per field period. All luminance generated by the sub-fields that are received at the same positions on the retina are integrated, resulting in a diagram in which the total luminance received by the retina has been drawn as a function of the position on the retina (this is shown in FIG. 2A). What can be seen is that the pattern on the retina still does not resemble the still image luminance ramp. There is still a bright vertical bar visible. This is the cause of contouring, there being only a slight change in luminance between two pixels which results in a perceptive bright or dark impression. What also can be seen is that there are gaps visible between the MSB sub-fields. These gaps are only visible from a close distance and are caused by the black matrix in between the pixels. From a greater distance, these gaps are not visible any more, which can also be said when the bright vertical line gets sufficiently small. What can be seen from this figure is that it looks as if the luminance contributions of the sub-fields are not projected on the same positions as the most significant sub-field weight. It is as if some sub-fields take positions in between the pixels, which is, in practice, not possible due to the discrete character of the display. This phenomenon is also explained in Mikoshiba, S. et al. appearance of false pixels and Degradation of picture quality in matrix displays having extended light-emission periods, SID 92 Digest, 1992, p.p. 659–662.

This is all due to the eye-tracking behavior of the eyes, which give the suggestion that all sub-fields are generated at the same time, which is not true.

Figure 3:
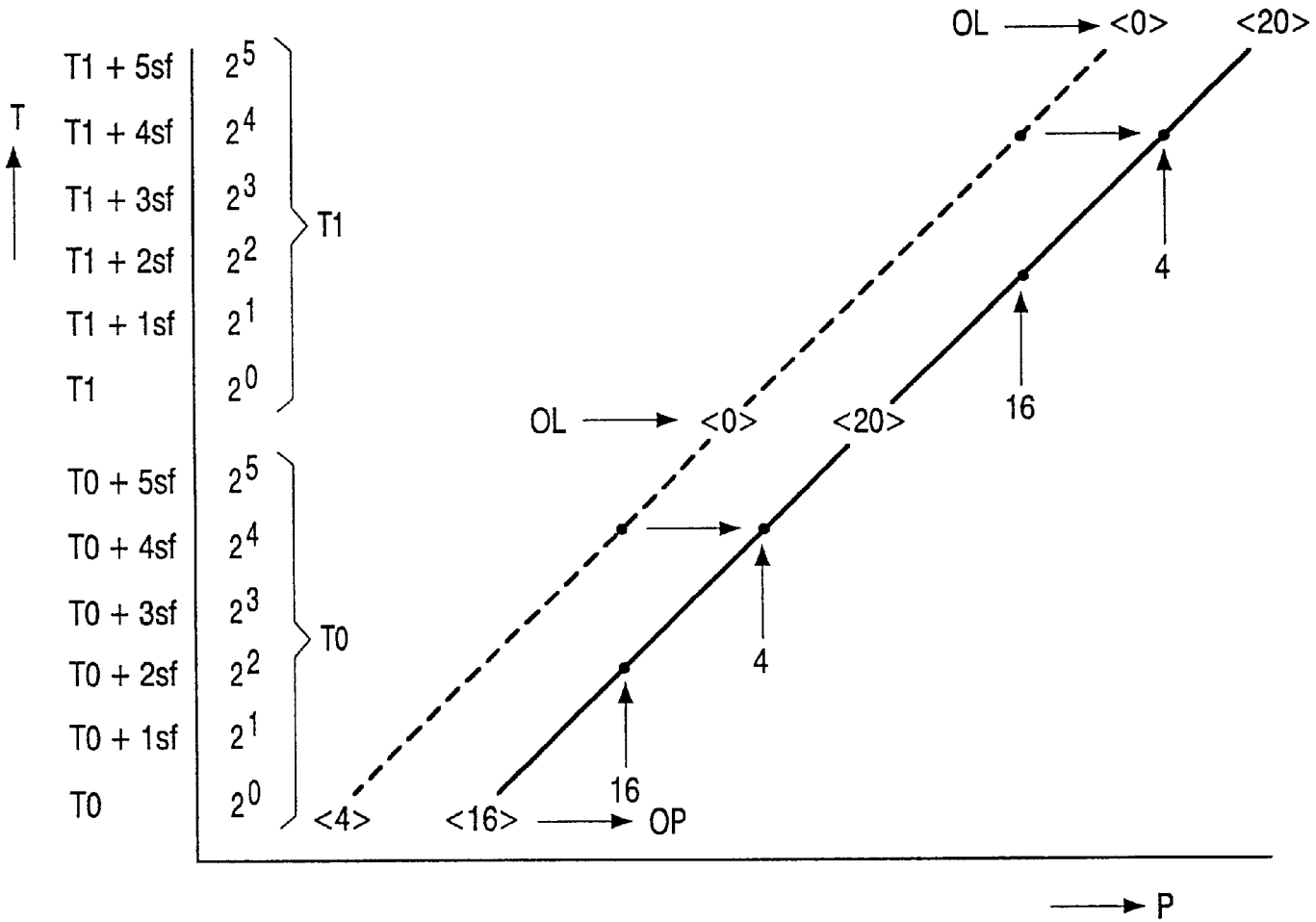
FIG. 3 illustrates motion compensation of one gray scale on the plasma screen.

As is known from the prior art, motion-compensation can help reduce the motion artefacts. In the Time vs. Position diagram of FIG. 3, compensation of a grey level of 20 is shown for two successive field T0 and T1. OL indicates the observed luminance, OP indicates the original positions. Without motion, and thus without motion-tracking by the eye, the values 4 and 16 are on top of each other and thus added: the correct luminance value of 20. When the luminance variations are determined by amplitude modulation as on a CRT, the luminance is generated on one position on the retina, and when this movement is being tracked, the same luminance is again generated on the same position on the retina. Since the gray-scale modulation on a plasma display is done on a sub-field basis and the object needs to have the same luminance during tracking, it is required to generate these separate sub-fields on the projected motion vector. When doing this, it can be seen, from FIG. 3, that no longer two vertical lines are observed on the motion vectors, but only one with a luminance of 20.

It can also be seen that to be able to do this, it is required to assign two vertical lines to two columns of pixels, i.e., one column is assigned the value 16 and the other gets the value 4. When inspecting one field of the image, two vertical lines are seen, but when whole moving sequence is observed (and this sequence is tracked by our eyes) only one vertical line is seen. Thus, to compensate for the error introduced by the motion and the tracking of the eyes, a luminance of 20 must be shown as projected on the motion vector. Thus, by shifting the luminance level of 4 to the right to a position on the motion vector, the right luminance level of the vertical line is obtained, when this pattern has a speed of 6 pixels per field period to the right.

Figure 4:
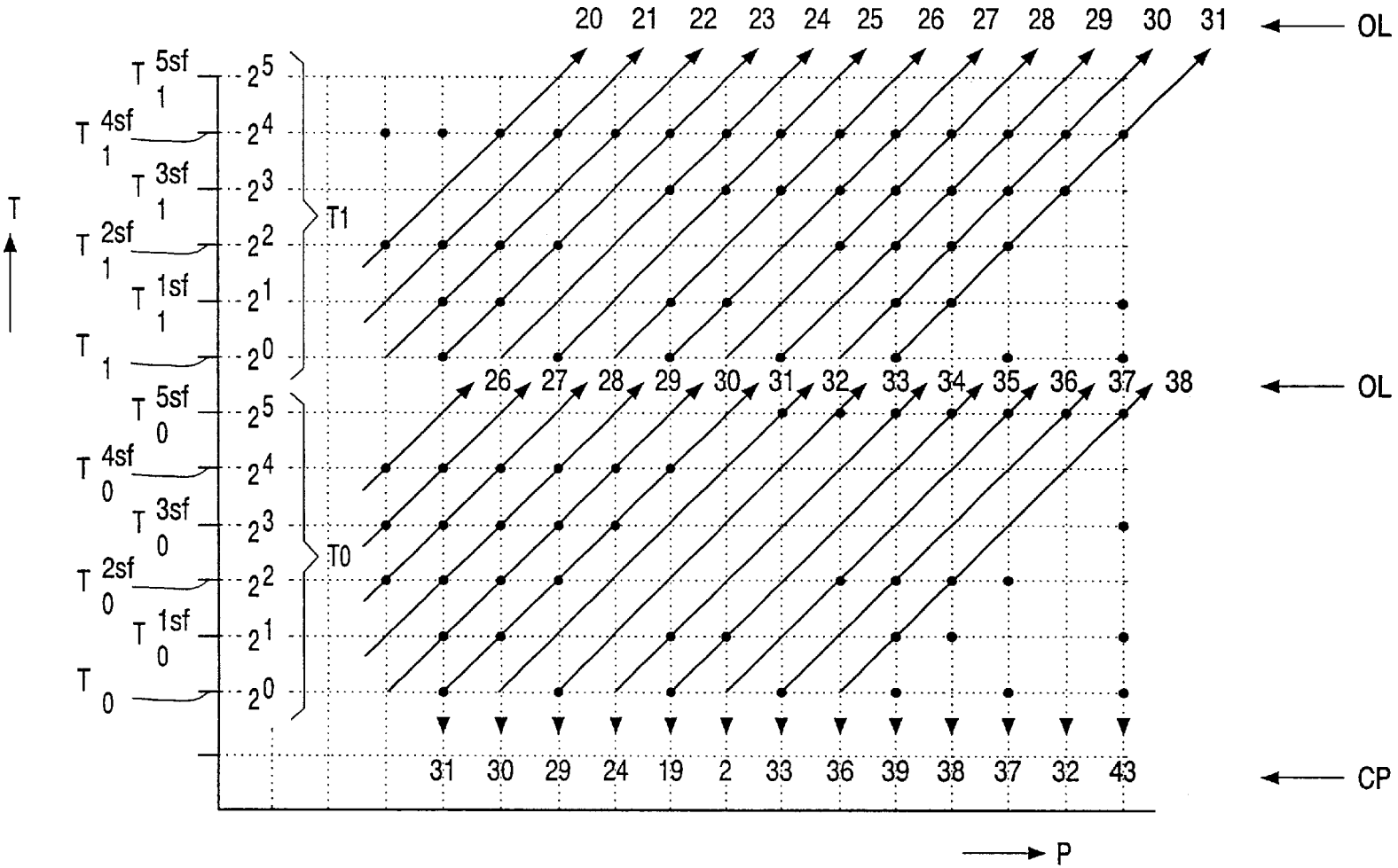
FIG. 4 illustrates a motion compensated luminance ramp.

The same method can be used for a luminance ramp. To compensate for this pattern, the luminance levels that are required are the luminance levels shown on the motion vectors, i.e., the luminance of the pixels that are shown is the luminance of the compensation pattern. This is shown in FIG. 4, in which OL indicates the obtained luminance when tracking, as a result of not putting the desired ramp itself, but the compensation pattern CP on the display. Thus, the luminance of the pixels that are visible, are the luminance projected on the motion vectors when the eyes are tracking the motion of 6 pixels per field period. What can be seen from this figure is that, when inspecting one field of this sequence at one position, a dark luminance level of 2 is shown, as in this case not the tracked motion, but the luminance of the compensation pattern CP is observed.

A matrix display panel, such as, a plasma display panel, comprises a set of data electrodes usually extending in the column direction and a set of scanning electrodes usually extending in the row direction.

Figure 5:
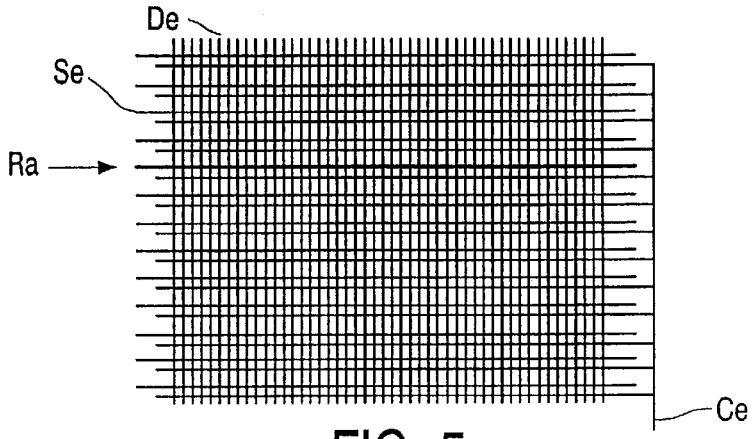
FIG. 5 schematically illustrates single line addressing.
Figure 6:
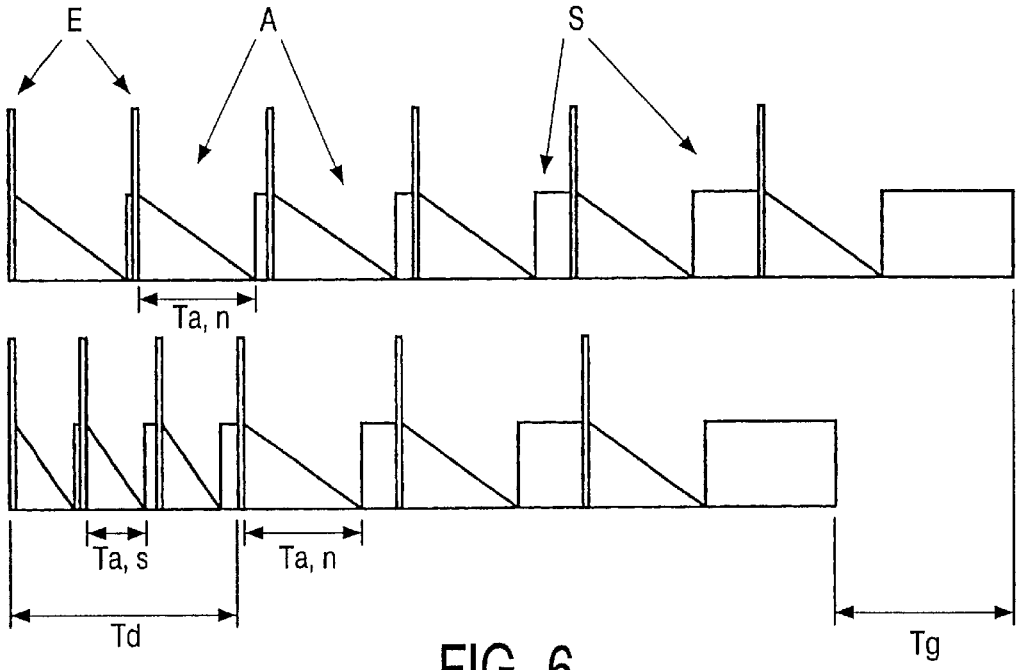
FIG. 6 shows a sub-field distribution, and the time gain obtained by double line addressing of the three least significant sub-fields.

FIG. 5 shows a display panel, where each row is addressed individually. The following electrodes are associated with each row: a data electrode De, scan electrode Se and a common electrode Ce. The arrow indicates the addressed row Ra. This leads to the timing diagram of a field shown in the upper half of FIG. 6, where the address period, or addressing time, Ta,n is the same for each sub-field. The address time Ta,n may be reduced by the so-called line doubling method, applied to some of the least significant sub-fields, and this is shown in the lower half of FIG. 6. In this method, a field as shown in FIG. 6 comprises, say, 6 sub-fields (in practice, 8 or up to 12 sub-fields are used). Each sub-field may comprise an erase period E for conditioning the panel, an address period A for conditioning the cells that should be lit during sustaining, and a sustain period S during which the actual light is generated. The sustain period of each sub-field is given, for example, a weight of 128, 64, 32, 16, 8, 4, 2, or 1 corresponding to an 8-bit digital signal (b7, b6, b5, b4, b3, b2, b1, b0) and allowing to obtain 256 luminance levels. The total sustain period for one field should be as long as possible in order to obtain a high brightness.

The erase period can be rather short, say, 0.2 ms, i.e., 8×0.2ms=1.6 ms per field. The address period is about 3 $\mu$s per line. For a VGA display, comprising 480 display lines, the address time per sub-field equals 480×3 $\mu$s=1.5 ms. At 8 sub-fields per field, the total address time is, therefore, 12 ms. At a field rate of 60 Hz (period 16.6 ms), only 3 ms is left as the total sustain time per field.

Figure 7:
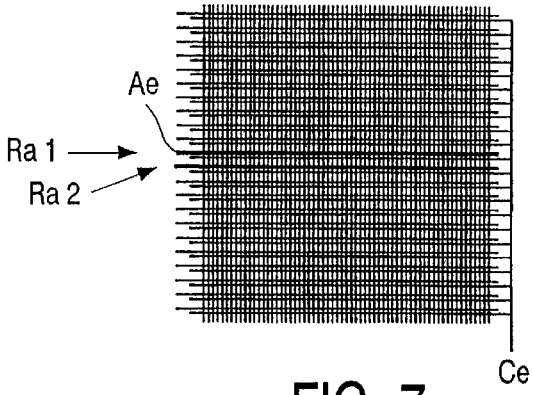
FIG. 7 schematically illustrates a method in which double line addressing is used.
Figure 10:
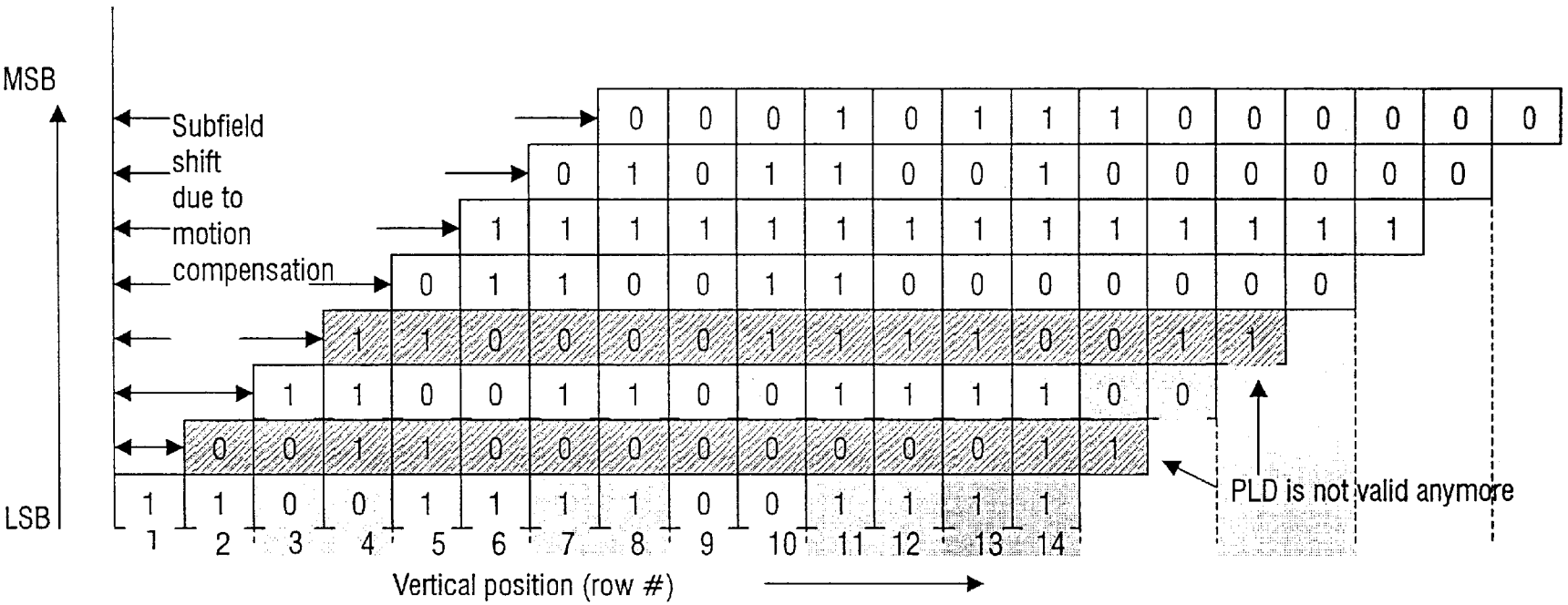
FIG. 10 schematically shows motion compensation shifts affecting the PLD.

FIG. 7 shows how two adjacent rows Ra1 and Ra2 are addressed at the same time, with the same data. The address time Ta,s is thereby reduced, leaving more time for the sustain period S. The high bars, referred to as E, represent the erase periods. The triangles, referred to as A, represent the address periods, and the rectangles, referred to as S, represent the sustain periods. In FIG. 10, The line doubling, which occurs during the period Td, causes a time gain Tg which can be used to increase the duration of the sustain period S.

It is possible to apply motion compensation first, and then apply partial line doubling (PLD) with copying of bits. The effect of motion compensation in case of averaging is possibly corrupted due to the PLD (so, it might not be very useful to apply motion compensation for those sub-fields). In case of copying of bits, one of the pixels is not affected and, therefore, also the motion compensation is not affected for that pixel by the PLD (for the first pixel, the bits are copied to the second, thus the sub-fields of the first pixel are not affected). For the second pixel, the motion compensation is partly lost and incorrect luminance values will be displayed, dependent of the change in value compared to the first pixel (when one or more sub-fields change that are not-partial line doubled). This solution can be used, but PLD with copy of bits averaging often leads to large reduction in image quality.

Figure 8:
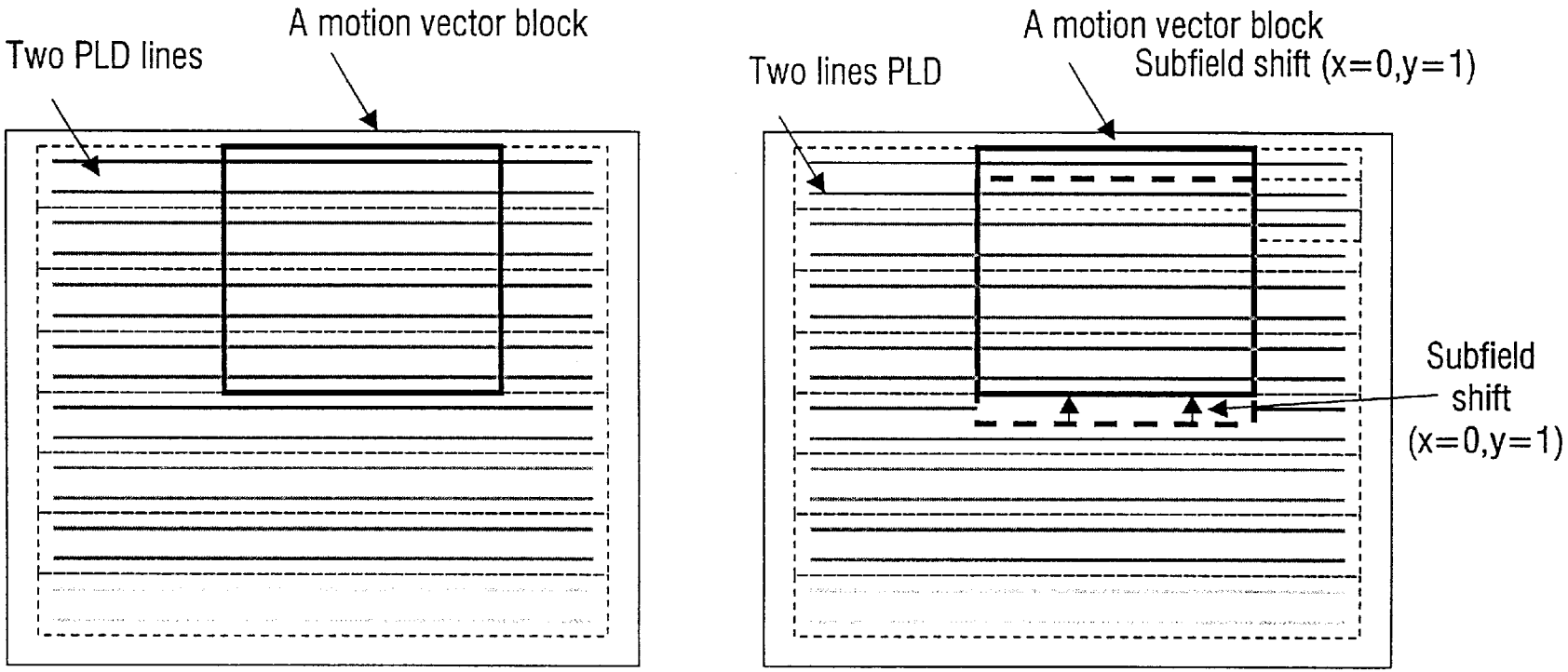
FIG. 8 schematically shows how the PLD is affected by a vertical sub-field shift.
Figure 9:
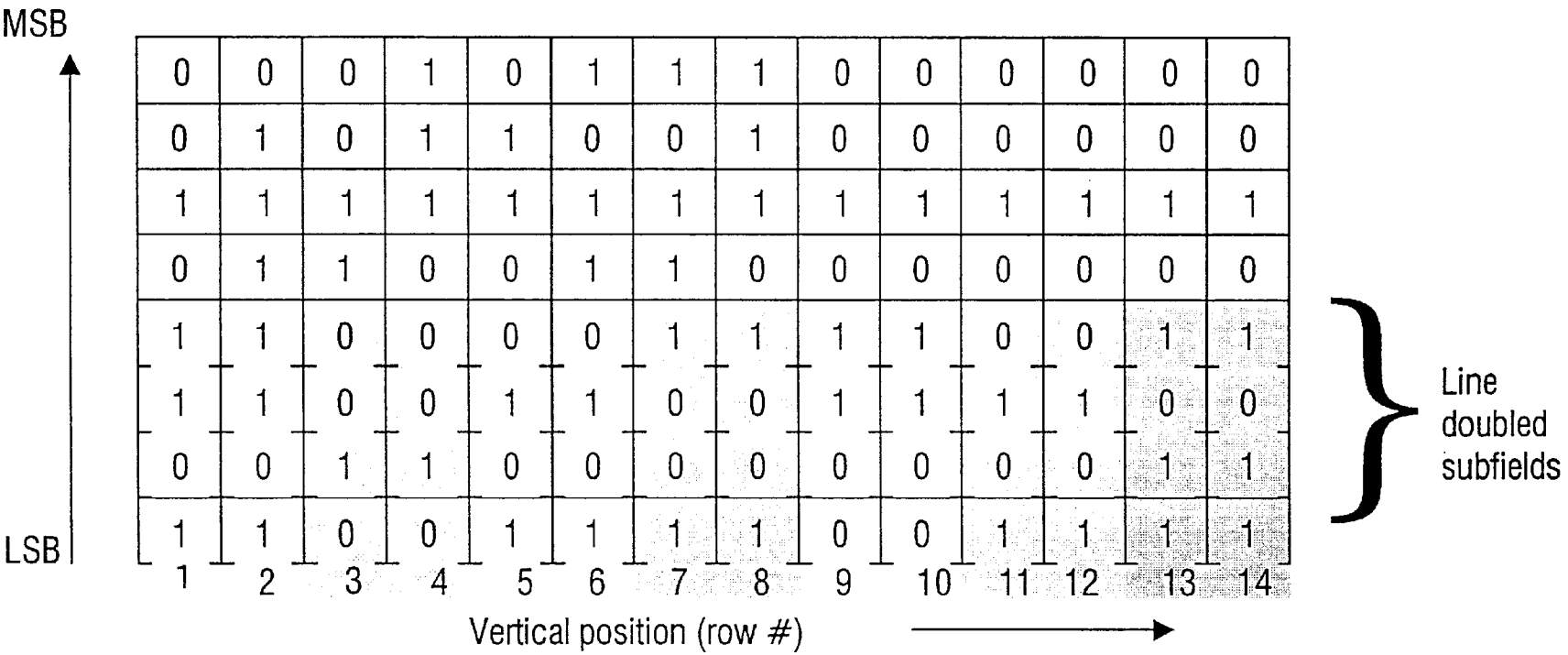
FIG. 9 schematically shows sub-field values from which four sub-fields are PLD treated for a number of lines.

In a further embodiment of this method, PLD is performed before the motion compensation. Thus, the two lines that are addressed simultaneously for the PLD must be the outcome data for the one sub-field that is being addressed at that moment. This must be the outcome of this solution. That this is not always the case is shown in FIGS. 8, 9 and 10. In FIG. 10 at lines 5 and 6, the sub-fields should have the same values, but this is not the case in the second and the fourth row from below, which are shaded and indicated by "PLD is not valid anymore".

In this embodiment, the vertical size of the motion vector block is a multiple of the number of lines that are doubled. Thus, when PLD is applied for 2 lines, the motion vector block is a multiple of 2, for example, a block of 8 lines high. In the examples used, a motion vector block 8×8 pixels has been assumed and a number of PLD lines of 2. When this is done, the motion compensation should be done in such a way that the PLD sub-fields that are shifted result in a new image, in which the lines that are addressed simultaneously still have the same sub-fields for the PLD lines. In this example, this is not the case when shifting of a sub-field in a vertical direction over an odd number of pixels is performed[S1]. For example, when PLD is applied for two lines at a time (lines 1 and 2, 3 and 4, etc.) the PLD sub-fields for line 1 and 2 are the same. When the least significant bit (LSB) is shifted over 1 pixel, the sub-field from line 2 up to 9 is, for example, shifted to line 1 up to 8. With PLD, the LSB sub-field for the lines 1 and 2, 3 and 4, 5 and 6 and 7 and 8 are the same before the motion compensation, but after the motion compensation, this is not longer the case, and the result of PLD is corrupted in many cases. This is shown in FIG. 9. In this figure, a PLD of 2 lines at a time and a motion vector block size of 8×8 pixels is assumed. In each dotted block, two lines represent two lines that are subjected to PLD. This is shown on the left side. On the right side, a vertical shift of 1 pixel has been applied, and it can be seen that it is no longer the case that dotted blocks contain two similar lines created by PLD.

Figure 11:
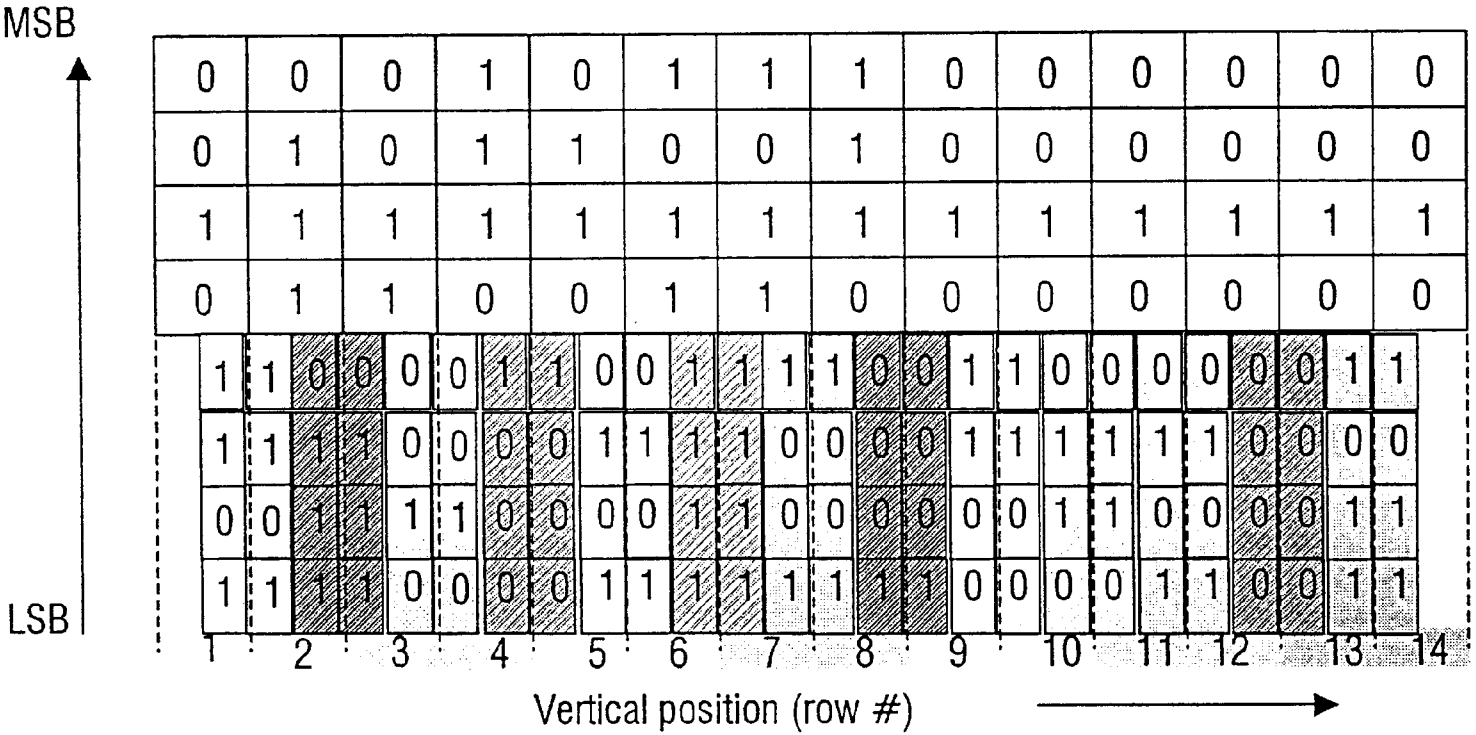
FIG. 11 schematically shows that the PLD is calculated for two times.
Figure 12:
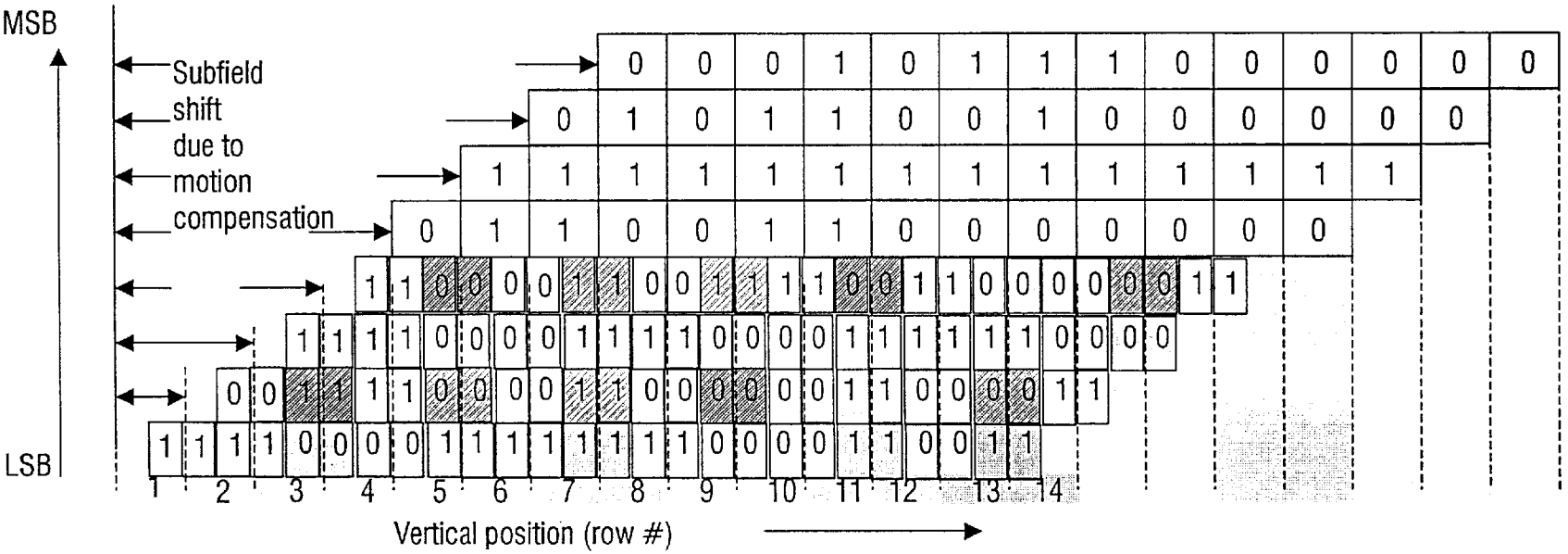
FIG. 12 schematically shows motion compensation shifts.
Figure 13:
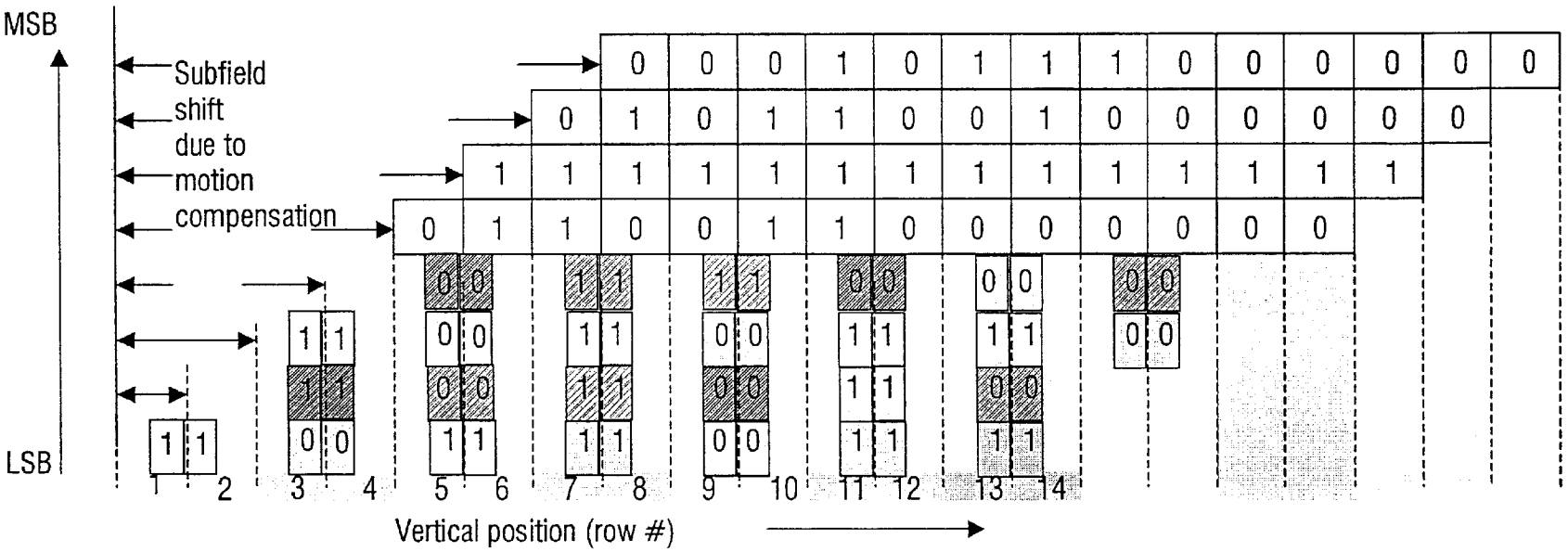
FIG. 13 schematically shows only the valid PLD data.
Figure 14:
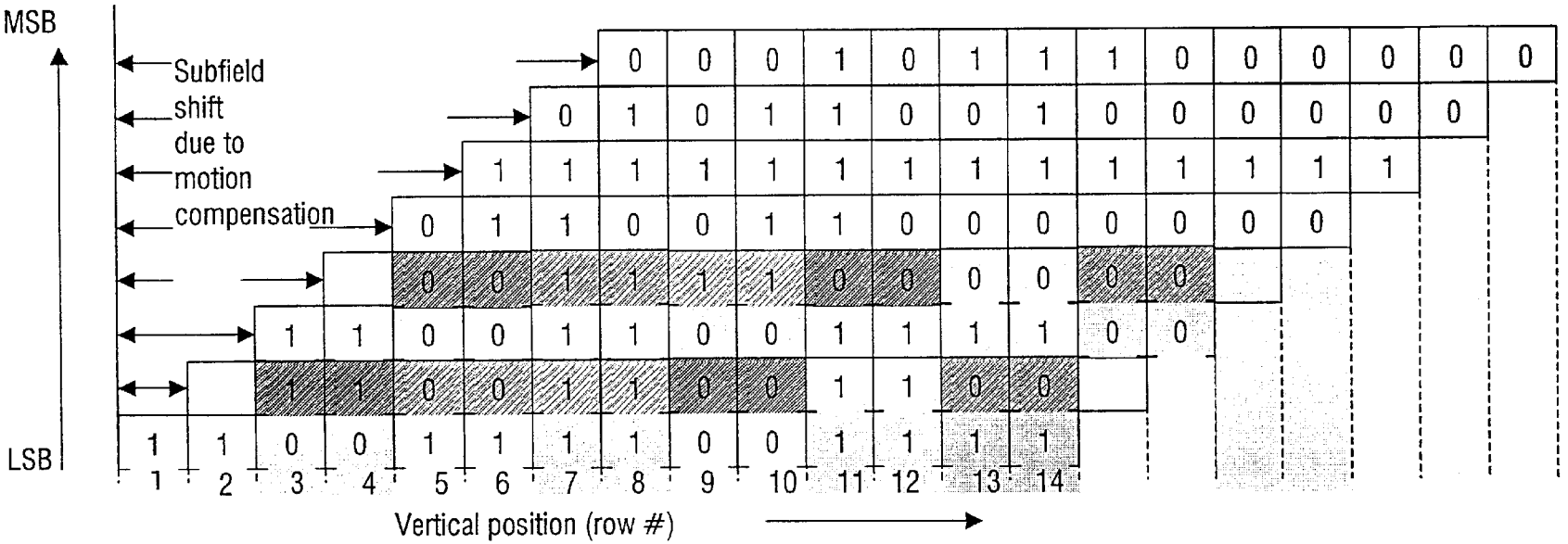
FIG. 14 schematically shows the final data resulting from the algorithm according to FIGS. 12–14.

According to the present invention, a method that enables using both motion compensation and PLD comprises steps to calculate the PLD two times. As is shown in FIG. 11, a first time to calculate the PLD is for lines one and two, three and four, 2N+1 and 2N+2 (the odd set). A second time that the PLD is calculated, this is done for lines two and three, four and five, 2N and 2N+1 (the even set). These PLD sub-fields can be stored in the even lines, when the values of the non-doubled sub-fields are independent of the calculation of the values of the doubled sub-fields. When, hereafter, motion compensation is applied and a sub-field shift of an odd number of pixels is applied it results in correct PLD sub-fields as is shown in FIGS. 12, 13 and 14. As is described in more detail below, FIG. 12 depicts calculating the PLD twice, FIG. 12 depicts executing the shift of the motion compensation, FIG. 13 depicts the choosing of sub-fields that fit with the PLD restraints, and FIG. 14 depicts the results of this method.

As is described in more detail below, an advantage hereof is that an algorithm, such as minimizing the error, averaging the data or copying the data, can be applied for PLD and the result is not affected by motion compensation.

As is shown in FIG. 14, the result of the procedure is that the PLD conditions (same sub-fields on PLD-lines) are satisfied while motion compensation is performed, whereby the gray areas have the same values. In case of a shift of an odd number of pixels, the shaded gray areas have correct values for partial line doubling. In FIG. 13, it is shown that only the valid PLD data are needed. In FIG. 14, valid data are shown in comparison to FIGS. 9 and 10.

Furthermore, it is possible to follow the above method, choosing the values of the sub-fields depending on the shift (even or odd) of the lowest non-doubled sub-field, or preferably on the highest doubled sub-field. In this way, all sub-fields are taken from the same sub-field control word.

In this embodiment, the PLD calculation is performed first and only once and then the doubled sub-fields are shifted by a half of the vertical spatial resolution, i.e., on a two-line-by-one-column basis coinciding with the line pairs of the PLD addressing. The non-doubled sub-fields are shifted with the full panel resolution (i.e., one-line-by-one-column) and their shifted position can have an even number, while non-doubled sub-fields can have any shift. The calculation of the shift can be written as:

$$\Delta y(\text{non-doubled } SFs) = v.\ dt$$

$$\Delta y(\text{doubled } SFs) = 2.\ \text{Round}\ (v.\ dt/2)$$

The algorithm is explained graphically in FIGS. 14–18. In these figures, shift motion compensation is represented. The squares indicate individual pixels.

Figure 15:
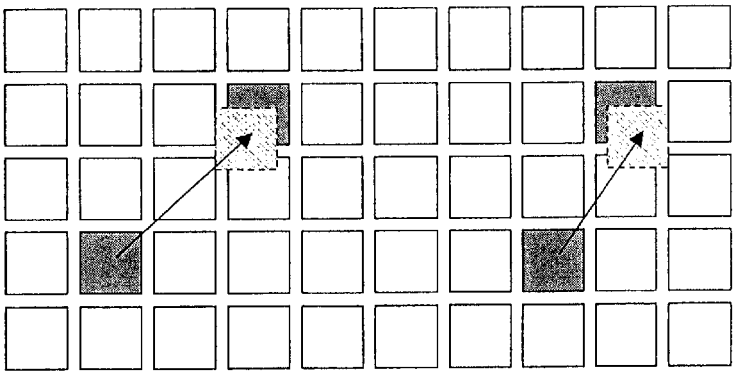
FIG. 15 schematically shows shift motion compensation for individual pixels.

In FIGS. 14 and 15, an embodiment is depicted in which the PLD data calculation is performed first and only once. Then the doubled sub-fields are shifted with half of the vertical spatial resolution, i.e., on a two-line-by-one-column basis coinciding with the line pairs of the PLD addressing. The non-doubled sub-fields are shifted with the full panel resolution (i.e., one-line-by-one-column) and their shifted position always matches the PLD pairing.

Sub-field shift for non-doubled sub-field is depicted in FIG. 14: the shaded square is shown together with its motion vector and destination pixel before rounding to the pixel grid (hashed square) and after rounding (filled square). The top example shows a shift over an even number of lines; the lower example shows a shift over an odd number of lines.

Sub-field shift for doubled sub-fields is depicted in FIG. 15: the open squares denote individual pixels and the rectangles with thick boundaries show how the sub-fields are paired according to the partial line doubled addressing. The shaded rectangle is shown together with its motion vector and destination before rounding to the two-line-by-one-column grid (hashed rectangle) and after rounding (filled rectangle). The top example shows a shift over an even number of lines; the lower example shows the rounding behavior to the 2 line grid when the shift is an odd number of lines.

This means that the sub-field control word for one pixel is "kept together" and shifted on the motion vector, rounded as closely as the addressing allows.

This way, strange effects, due to break-up of sub-field control words, is prevented. One could expect a slight loss in vertical resolution, but experiments doubling 4 or 6 out of 8 binary sub-fields show an effect that is hardly noticeable. Sharp edges, which show some staircase effects, even appear to be better displayed when using the method.

Preferably, the blocks of the motion estimator (typically 8×8 pixels) should be aligned with the PLD line pairs.

Figure 17:
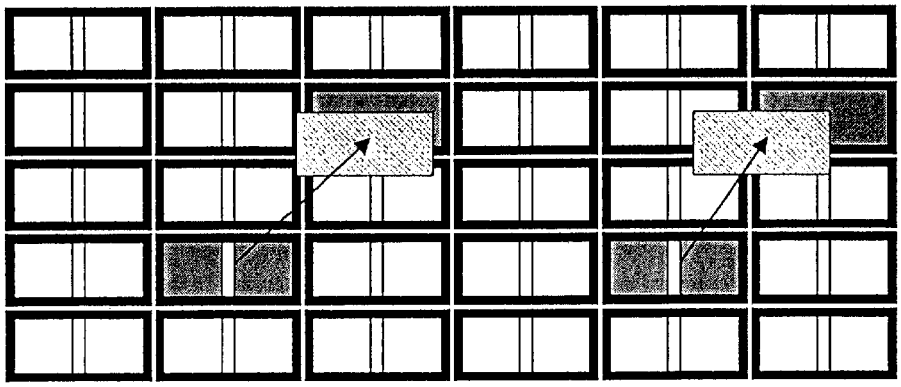
FIG. 17 schematically shows sub-field shifts for doubled sub-fields.
Figure 16:
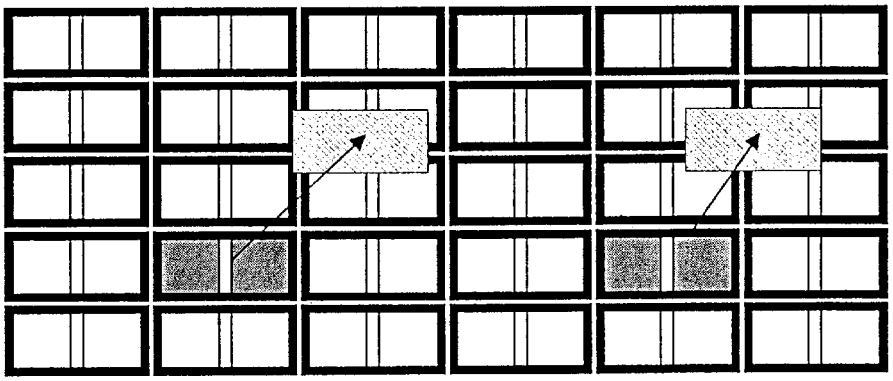
FIG. 16 schematically shows sub-field shifts for doubled sub-fields.
Figure 18:
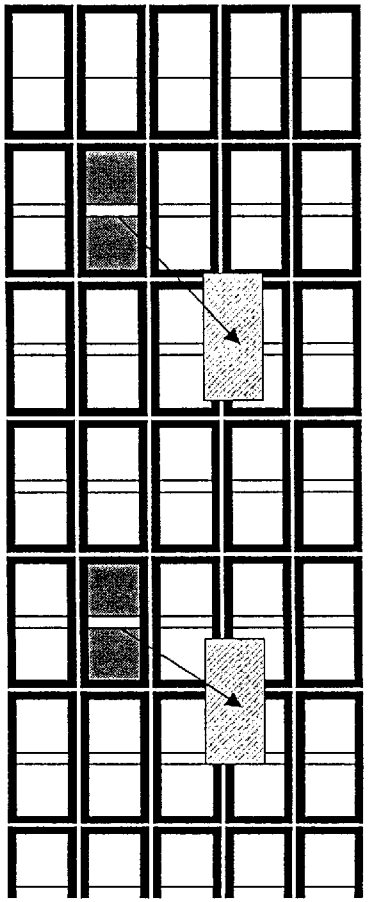
FIG. 18 schematically shows sub-field shifts for doubled sub-fields.

In FIG. 16, the resolution is enhanced by shifting the PLD grid by one line. This is done by calculating the PLD values twice: once for line 1+2, 3+4, . . . (the so called 'odd set') and once for line 2+3, 4+5, . . . (the so called 'even set' named after the top of the two PLD lines having an odd or even number). This is depicted in FIGS. 16–18. The choice between the two source sets is then made depending of the optimum choice for preferably the highest double sub-field (in case that is shifted with the maximum effective resolution) of when the shift is to be performed over an even number of lines for this sub-field, the odd set is used for all sub-fields; when it is odd, the even set is used.

When it is known whether the shift of the highest doubled sub-field is even or odd before the PLD data calculation is performed, it is possible to use this knowledge and perform the data calculation only for the required set.

In FIG. 16, the behavior when the odd set is chosen: the dark squares represent the source sets and the lighter squares represent the target for shifting, which is indicated also by the arrows.

In FIGS. 17 and 18, a similar situation is shown in which the dark squares represent source sets and the lighter squares represent target sets after shifting according to the arrows.

In FIGS. 16–18, it can be seen that, sometimes, the best fit results from a shift using an even set (FIG. 16 upper sets) and sometimes the best fit results from a shift using an odd set (FIG. 18 lower set).

Figure 20:
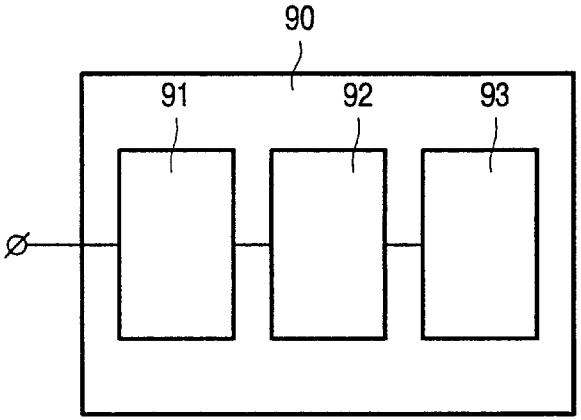
FIG. 20 shows another embodiment according to the invention.
Figure 19:
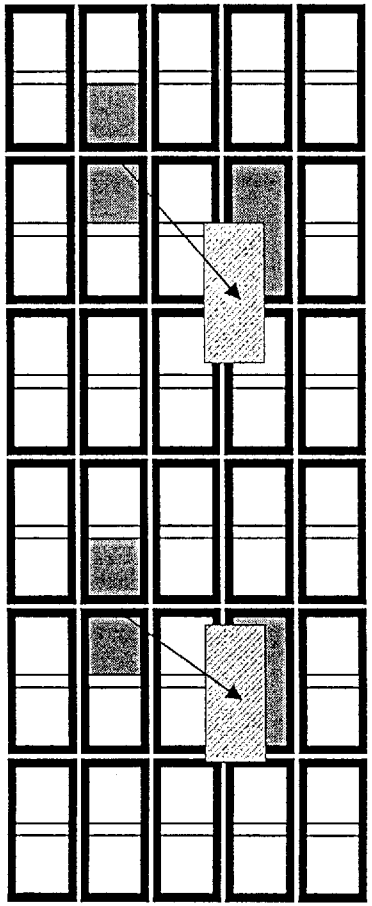
FIG. 19 schematically shows sub-field shifts for doubled sub-fields.

Another embodiment, according to the invention (FIG. 20), is an image display apparatus 90 comprising a receiving part 91 for receiving a signal representing an image to be displayed. The signal may be a broadcast signal received via an antenna or cable, and may also be a signal from a storage device, like a VCR (video cassette recorder) or a DVD (digital versatile disk). The image apparatus 90 further has an image processing part 92 for processing the image and a display panel 93 for displaying the processed image. The display panel 93 is of a type that is driven in sub-fields. The image-processing unit is performing at least partial line doubling and motion compensation. Other processing, like luminance to sub-field transformation can also be performed by the image processing part 92.

The present invention is not limited to the above described preferred embodiments, the rights sought being defined by the following claims.

What is claimed is:

1. A method of driving a display wherein a field period for the display is divided into several sub-fields, said method comprising the steps:

compensating a number of sub-fields values for motion artifacts; and addressing at least one of the sub-fields in two or more lines simultaneously.

2. The method as claimed in claim 1, wherein the step of addressing of subsequent lines is performed first whereafter the method comprises performing shift motion compensation.

3. The method as claimed in claim 1, wherein the step of motion compensation is applied first, whereafter the method comprises executing partial line doubling.

4. The method as claimed in claim 2, wherein said method comprises performing shift motion compensation for non-doubled sub-fields.

5. The method as claimed in claim 1, wherein said method comprises first performing partial line doubling for all sets of lines 2N and 2N+1 and for all sets of lines 2N+1 and 2N+2.

6. The method as claimed in claim 1, in which a vertical block size of a motion vector is a multiple of a number of lines that are doubled.

7. The method as claimed in claim 1, in which the partial line doubling comprises steps for minimizing the error during the data calculation.

8. The method as claimed in claim 1, in which the partial line doubling comprises steps for averaging the data during the data calculation.

9. The method as claimed in claim 1, in which the partial line doubling comprises steps for copying the data during the data calculation.

10. The method as claimed in claim 1, in which values of the sub-fields depend on a shift of the highest doubled sub-field.

11. The method as claimed in claim 1, in which values of the sub-fields depend on a shift of the lowest non-doubled sub-field.

12. The method as claimed in claim 10, in which partial line doubling is calculated once when the shift is over an even or an odd number of lines and this is part of an input to the calculation.

13. The method as claimed in claim 1, in which the doubled sub-fields are shifted with the same resolution in which the partial line doubling is performed.

14. An image processing apparatus for driving a display wherein a field period for the display is divided into several sub-fields, said image processing apparatus comprising:

means for compensating a number of sub-fields values for motion artifacts; and means for addressing at least one of the sub-fields in two or more lines simultaneously.

15. An image display apparatus comprising a display; and image processing apparatus for driving the display wherein a field period for the display is divided into several sub-fields, said image processing apparatus comprising means for compensating a number of sub-fields values for motion artifacts, and means for addressing at least one of the sub-fields in two or more lines simultaneously.

* * * * *